US008616305B2

(12) United States Patent
Hall et al.

(10) Patent No.: US 8,616,305 B2
(45) Date of Patent: Dec. 31, 2013

(54) FIXED BLADED BIT THAT SHIFTS WEIGHT BETWEEN AN INDENTER AND CUTTING ELEMENTS

(75) Inventors: David R. Hall, Provo, UT (US); Ronald B. Crockett, Payson, UT (US); Marcus Skeem, Provo, UT (US); Francis Leany, Salem, UT (US); Casey Webb, Provo, UT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 492 days.

(21) Appl. No.: 12/619,377

(22) Filed: Nov. 16, 2009

(65) Prior Publication Data

US 2010/0089648 A1 Apr. 15, 2010

Related U.S. Application Data

(63) Continuation-in-part of application No. 12/619,305, filed on Nov. 16, 2009, which is a continuation-in-part of application No. 11/766,975, filed on Jun. 22, 2007, now Pat. No. 8,122,980, application No. 12/619,377, which is a continuation-in-part of application No. 11/774,227, filed on Jul. 6, 2007, now Pat. No. 7,669,938, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, now abandoned, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 12/619,377, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770, application No. 12/619,377, which is a continuation-in-part of application No. 11/673,634, filed on Feb. 12, 2007, now Pat. No. 8,109,349.

(51) Int. Cl.
*E21B 10/26* (2006.01)

(52) U.S. Cl.
USPC ..... 175/389

(58) Field of Classification Search
USPC ..... 175/385, 389
See application file for complete search history.

(56) References Cited

U.S. PATENT DOCUMENTS 465,103 A 12/1891 Wegner
616,118 A 12/1898 Kunhe (Continued)

*Primary Examiner* — John Kreck
(74) *Attorney, Agent, or Firm* — Osha Liang LLP

(57) ABSTRACT

In one aspect of the present invention, a downhole fixed bladed bit comprises a working surface comprising a plurality of blades converging at a center of the working surface and diverging towards a gauge of the bit, at least on blade comprising a cutting element comprising a superhard material bonded to a cemented metal carbide substrate at a non-planer interface, the cutting element being positioned at a positive rake angle, and the superhard material comprising a substantially conical geometry with an apex comprising a curvature.

14 Claims, 17 Drawing Sheets

(56) References Cited

U.S. PATENT DOCUMENTS

| | | | | | |
|---|---|---|---|---|---|
| 946,060 | A | | 1/1910 | Looker | |
| 1,116,154 | A | | 11/1914 | Stowers | |
| 1,183,630 | A | | 5/1916 | Bryson | |
| 1,189,560 | A | | 7/1916 | Gondos | |
| 1,360,908 | A | | 11/1920 | Everson | |
| 1,387,733 | A | | 8/1921 | Midgett | |
| 1,460,671 | A | | 7/1923 | Hebsacker | |
| 1,544,757 | A | | 7/1925 | Hufford et al. | |
| 1,821,474 | A | | 9/1931 | Mercer | |
| 1,879,177 | A | | 9/1932 | Gault | |
| 2,054,255 | A | | 9/1936 | Howard | |
| 2,064,255 | A | | 12/1936 | Garfield | |
| 2,169,223 | A | | 8/1939 | Christian | |
| 2,218,130 | A | | 10/1940 | Court | |
| 2,320,136 | A | | 5/1943 | Kammerer | |
| 2,755,071 | A | | 7/1956 | Kammerer | |
| 2,776,819 | A | | 1/1957 | Brown | |
| 2,819,043 | A | | 1/1958 | Henderson | |
| 2,838,284 | A | | 6/1958 | Austin | |
| 2,894,722 | A | | 7/1959 | Buttolph | |
| 2,901,223 | A | | 8/1959 | Scott | |
| 2,963,102 | A | | 12/1960 | J.E. Smith | |
| 2,998,085 | A | * | 8/1961 | Dulaney | 175/100 |
| 3,135,341 | A | | 6/1964 | Ritter | |
| 3,294,186 | A | | 12/1966 | Buell | |
| 3,301,339 | A | | 1/1967 | Pennebaker, Jr. | |
| 3,379,264 | A | | 4/1968 | Cox | |
| 3,429,390 | A | * | 2/1969 | Bennett | 175/343 |
| 3,493,165 | A | | 2/1970 | Schonfeld | |
| 3,583,504 | A | | 6/1971 | Aalund | |
| 3,765,493 | A | | 10/1973 | Rosar et al. | |
| 3,821,993 | A | * | 7/1974 | Kniff | 175/292 |
| 3,955,635 | A | | 5/1976 | Skidmore | |
| 3,960,223 | A | | 6/1976 | Kleine | |
| 4,081,042 | A | | 3/1978 | Johnson et al. | |
| 4,094,197 | A | | 6/1978 | Harris, Sr. et al. | |
| 4,106,577 | A | | 8/1978 | Summers | |
| 4,109,737 | A | | 8/1978 | Bovenkerk | |
| 4,176,723 | A | | 12/1979 | Arceneaux | |
| 4,253,533 | A | | 3/1981 | Baker, III | |
| 4,280,573 | A | | 7/1981 | Sudnishnikov et al. | |
| 4,304,312 | A | | 12/1981 | Larsson | |
| 4,307,786 | A | | 12/1981 | Evans | |
| 4,397,361 | A | | 8/1983 | Langford, Jr. | |
| 4,416,339 | A | | 11/1983 | Baker et al. | |
| 4,445,580 | A | | 5/1984 | Sahley | |
| 4,448,269 | A | | 5/1984 | Ishikawa et al. | |
| 4,499,795 | A | | 2/1985 | Radtke | |
| 4,531,592 | A | | 7/1985 | Hayatdavoudi | |
| 4,535,853 | A | | 8/1985 | Ippolito et al. | |
| 4,538,691 | A | | 9/1985 | Dennis | |
| 4,566,545 | A | | 1/1986 | Story et al. | |
| 4,574,895 | A | | 3/1986 | Dolezal et al. | |
| 4,640,374 | A | | 2/1987 | Dennis | |
| 4,729,441 | A | * | 3/1988 | Peetz et al. | 175/385 |
| 4,765,419 | A | * | 8/1988 | Scholz et al. | 175/415 |
| 4,852,672 | A | | 8/1989 | Behrens | |
| 4,889,017 | A | | 12/1989 | Fuller et al. | |
| 4,962,822 | A | | 10/1990 | Pascale | |
| 4,981,184 | A | | 1/1991 | Knowlton et al. | |
| 5,009,273 | A | | 4/1991 | Grabinski | |
| 5,027,914 | A | | 7/1991 | Wilson | |
| 5,038,873 | A | | 8/1991 | Jurgens | |
| 5,119,892 | A | | 6/1992 | Clegg et al. | |
| 5,141,063 | A | | 8/1992 | Quesenbury | |
| 5,186,268 | A | | 2/1993 | Clegg | |
| 5,222,566 | A | | 6/1993 | Taylor et al. | |
| 5,255,749 | A | | 10/1993 | Bumpurs et al. | |
| 5,265,682 | A | | 11/1993 | Russell et al. | |
| 5,361,859 | A | | 11/1994 | Tibbitts | |
| 5,410,303 | A | | 4/1995 | Comeau et al. | |
| 5,417,292 | A | | 5/1995 | Polakoff | |
| 5,423,389 | A | | 6/1995 | Warren et al. | |
| 5,507,357 | A | | 4/1996 | Hult et al. | |
| 5,560,440 | A | | 10/1996 | Tibbitts | |
| 5,568,838 | A | | 10/1996 | Struthers et al. | |
| 5,655,614 | A | | 8/1997 | Azar | |
| 5,678,644 | A | | 10/1997 | Fielder | |
| 5,732,784 | A | * | 3/1998 | Nelson | 175/385 |
| 5,794,728 | A | | 8/1998 | Palmberg | |
| 5,848,657 | A | | 12/1998 | Flood et al. | |
| 5,896,938 | A | | 4/1999 | Moeny et al. | |
| 5,947,215 | A | | 9/1999 | Lundell | |
| 5,950,743 | A | | 9/1999 | Cox | |
| 5,957,223 | A | | 9/1999 | Doster et al. | |
| 5,957,225 | A | | 9/1999 | Sinor | |
| 5,967,247 | A | | 10/1999 | Pessier | |
| 5,979,571 | A | | 11/1999 | Scott et al. | |
| 5,992,547 | A | | 11/1999 | Caraway et al. | |
| 5,992,548 | A | | 11/1999 | Silva et al. | |
| 6,021,859 | A | | 2/2000 | Tibbitts et al. | |
| 6,039,131 | A | | 3/2000 | Beaton | |
| 6,131,675 | A | | 10/2000 | Anderson | |
| 6,150,822 | A | | 11/2000 | Hong et al. | |
| 6,186,251 | B1 | | 2/2001 | Butcher | |
| 6,202,761 | B1 | | 3/2001 | Forney | |
| 6,213,226 | B1 | | 4/2001 | Eppink et al. | |
| 6,223,824 | B1 | | 5/2001 | Moyes | |
| 6,269,893 | B1 | | 8/2001 | Beaton et al. | |
| 6,296,069 | B1 | | 10/2001 | Lamine et al. | |
| 6,332,503 | B1 | | 12/2001 | Pessier et al. | |
| 6,340,064 | B2 | | 1/2002 | Fielder et al. | |
| 6,364,034 | B1 | | 4/2002 | Schoeffler | |
| 6,394,200 | B1 | | 5/2002 | Watson et al. | |
| 6,408,959 | B2 | | 6/2002 | Bertagnolli et al. | |
| 6,439,326 | B1 | | 8/2002 | Huang et al. | |
| 6,474,425 | B1 | | 11/2002 | Truax et al. | |
| 6,484,825 | B2 | | 11/2002 | Watson et al. | |
| 6,484,826 | B1 | | 11/2002 | Anderson et al. | |
| 6,510,906 | B1 | | 1/2003 | Richert et al. | |
| 6,513,606 | B1 | | 2/2003 | Krueger | |
| 6,533,050 | B2 | | 3/2003 | Molloy | |
| 6,594,881 | B2 | | 7/2003 | Tibbitts | |
| 6,601,454 | B1 | | 8/2003 | Botnan | |
| 6,622,803 | B2 | | 9/2003 | Harvey et al. | |
| 6,668,949 | B1 | | 12/2003 | Rives | |
| 6,672,406 | B2 | | 1/2004 | Beuershausen | |
| 6,729,420 | B2 | | 5/2004 | Mensa-Wilmot | |
| 6,732,817 | B2 | | 5/2004 | Dewey et al. | |
| 6,822,579 | B2 | | 11/2004 | Goswami et al. | |
| 6,929,076 | B2 | | 8/2005 | Fanuel et al. | |
| 6,953,096 | B2 | | 10/2005 | Gledhill et al. | |
| 8,011,457 | B2 | * | 9/2011 | Hall et al. | 175/389 |
| 8,225,883 | B2 | * | 7/2012 | Hall et al. | 175/57 |
| 2001/0004946 | A1 | | 6/2001 | Jensen | |
| 2003/0213621 | A1 | | 11/2003 | Britten et al. | |
| 2004/0238221 | A1 | | 12/2004 | Runia et al. | |
| 2004/0256155 | A1 | | 12/2004 | Kriesels et al. | |

* cited by examiner

FIXED BLADED BIT THAT SHIFTS WEIGHT BETWEEN AN INDENTER AND CUTTING ELEMENTS

CROSS REFERENCE TO RELATED APPLICATION

This application is a continuation-in-part of U.S. patent application Ser. No. 12/619,305 filed Nov. 16, 2009, which is a continuation-in-part of U.S. patent application Ser. No. 11/766,975 and was filed on Jun. 22, 2007 now U.S. Pat. No. 8,122,980. This application is also a continuation-in-part of U.S. patent application Ser. No. 11/774,227 which was filed on Jul. 6, 2007 now U.S. Pat. No. 7,669,938. U.S. patent application Ser. No. 11/774,227 is a continuation-in-part of U.S. patent application Ser. No. 11/773,271 which was filed on Jul. 3, 2007 now U.S. Pat. No. 7,997,661. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 which was filed on Apr. 30, 2007 now U.S. Pat. No. 7,475,948. U.S. patent application Ser. No. 11/742,304 is a continuation of U.S. patent application Ser. No. 11/742,261 which was filed on Apr. 30, 2007 now U.S. Pat. No. 7,469,971. U.S. patent application Ser. No. 11/742,261 is a continuation-in-part of U.S. patent application Ser. No. 11/464,008 which was filed on Aug. 11, 2006 now U.S. Pat. No. 7,338,135. U.S. patent application Ser. No. 11/464,008 is a continuation-in-part of U.S. patent application Ser. No. 11/463,998 which was filed on Aug. 11, 2006 now U.S. Pat. No. 7,384,105. U.S. patent application Ser. No. 11/463,998 is a continuation-in-part of U.S. patent application Ser. No. 11/463,990 which was filed on Aug. 11, 2006 now U.S. Pat. No. 7,320,505. U.S. patent application Ser. No. 11/463,990 is a continuation-in-part of U.S. patent application Ser. No. 11/463,975 which was filed on Aug. 11, 2006 now U.S. Pat. No. 7,445,294. U.S. patent application Ser. No. 11/463,975 is a continuation-in-part of U.S. patent application Ser. No. 11/463,962 which was filed on Aug. 11, 2006 now U.S. Pat. No. 7,413,256. U.S. patent application Ser. No. 11/463,962 is a continuation-in-part of U.S. patent application Ser. No. 11/463,953, which was also filed on Aug. 11, 2006 now U.S. Pat. No. 7,464,993. The present application is also a continuation-in-part of U.S. patent application Ser. No. 11/695,672 which was filed on Apr. 3, 2007 now U.S. Pat. No. 7,396,086. U.S. patent application Ser. No. 11/695,672 is a continuation-in-part of U.S. patent application Ser. No. 11/686,831 filed on Mar. 15, 2007. This application is also a continuation in part of U.S. patent application Ser. No. 11/673,634 filed Feb. 12, 2007 now U.S. Pat. No. 8,109,349. All of these applications are herein incorporated by reference for all that they contain.

BACKGROUND OF THE INVENTION

This invention relates to drill bits, specifically drill bit assemblies for use in oil, gas and geothermal drilling. More particularly, the invention relates to cutting elements in fix bladed bits comprised of a carbide substrate with a non-planar interface and an abrasion resistant layer of super hard material affixed thereto using a high pressure high temperature press apparatus.

Cutting elements typically comprise a cylindrical super hard material layer or layers formed under high temperature and pressure conditions, usually in a press apparatus designed to create such conditions, cemented to a carbide substrate containing a metal binder or catalyst such as cobalt. A cutting element or insert is normally fabricated by placing a cemented carbide substrate into a container or cartridge with a layer of diamond crystals or grains loaded into the cartridge adjacent one face of the substrate. A number of such cartridges are typically loaded into a reaction cell and placed in the high pressure high temperature press apparatus. The substrates and adjacent diamond crystal layers are then compressed under HPHT conditions which promotes a sintering of the diamond grains to form the polycrystalline diamond structure. As a result, the diamond grains become mutually bonded to form a diamond layer over the substrate interface. The diamond layer is also bonded to the substrate interface.

Such cutting elements are often subjected to intense forces, torques, vibration, high temperatures and temperature differentials during operation. As a result, stresses within the structure may begin to form. Drag bits for example may exhibit stresses aggravated by drilling anomalies during well boring operations such as bit whirl or bounce often resulting in spalling, delamination or fracture of the super hard abrasive layer or the substrate thereby reducing or eliminating the cutting elements efficacy and decreasing overall drill bit wear life. The super hard material layer of a cutting element sometimes delaminates from the carbide substrate after the sintering process as well as during percussive and abrasive use. Damage typically found in drag bits may be a result of shear failures, although non-shear modes of failure are not uncommon. The interface between the super hard material layer and substrate is particularly susceptible to non-shear failure modes due to inherent residual stresses.

U.S. Pat. No. 6,332,503 by Pessier et al, which is herein incorporated by reference for all that it contains, discloses an array of chisel-shaped cutting elements are mounted to the face of a fixed cutter bit. Each cutting element has a crest and an axis which is inclined relative to the borehole bottom. The chisel-shaped cutting elements may be arranged on a selected portion of the bit, such as the center of the bit, or across the entire cutting surface. In addition, the crest on the cutting elements may be oriented generally parallel or perpendicular to the borehole bottom.

U.S. Pat. No. 6,408,959 by Bertagnolli et al., which is herein incorporated by reference for all that it contains, discloses a cutting element, insert or compact which is provided for use with drills used in the drilling and boring of subterranean formations.

U.S. Pat. No. 6,484,826 by Anderson et al., which is herein incorporated by reference for all that it contains, discloses enhanced inserts formed having a cylindrical grip and a protrusion extending from the grip.

U.S. Pat. No. 5,848,657 by Flood et al, which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer.

U.S. Pat. No. 4,109,737 by Bovenkerk which is herein incorporated by reference for all that it contains, discloses a rotary bit for rock drilling comprising a plurality of cutting elements mounted by interference-fit in recesses in the crown of the drill bit. Each cutting element comprises an elongated pin with a thin layer of polycrystalline diamond bonded to the free end of the pin.

US Patent Application Serial No. 2001/0004946 by Jensen, although now abandoned, is herein incorporated by reference for all that it discloses. Jensen teaches that a cutting element or insert with improved wear characteristics while maximizing the manufacturability and cost effectiveness of the insert. This insert employs a superabrasive diamond layer of increased depth and by making use of a diamond layer surface that is generally convex.

BRIEF SUMMARY OF THE INVENTION

In one aspect of the present invention, a downhole fixed bladed bit comprises a working surface comprising a plurality of blades converging at a center of the working surface and diverging towards a gauge of the bit, at least on blade comprising a cutting element comprising a superhard material bonded to a cemented metal carbide substrate at a non-planer interface, the cutting element being positioned at a positive rake angle, and the superhard material comprising a substantially conical geometry with an apex comprising a curvature.

In some embodiments, the positive rake angle may be between 15 and 20 degrees, and may be substantially 17 degrees. The cutting element may comprise the characteristic of inducing fractures ahead of itself in a formation when the drill bit is drilling through the formation. The cutting element may comprise the characteristic of inducing fractures peripherally ahead of itself in a formation when the drill bit is drilling through the formation.

The substantially conical geometry may comprise a side wall that tangentially joins the curvature, wherein the cutting element is positioned to indent at a positive rake angle, while a leading portion of the side wall is positioned at a negative rake angle.

The cutting element may be positioned on a flank of the at least one blade, and may be positioned on a gauge of the at least one blade. The included angle of the substantially conical geometry may be 75 to 90 degrees. The superhard material may comprise sintered polycrystalline diamond. The sintered polycrystalline diamond may comprise a volume with less than 5 percent catalyst metal concentration, while 95% of the interstices in the sintered polycrystalline diamond comprise a catalyst.

The non-planer interface may comprise an elevated flatted region that connects to a cylindrical portion of the substrate by a tapered section. The apex may join the substantially conical geometry at a transition that comprises a diameter of width less than a third of a diameter of width of the carbide substrate. In some embodiments, the diameter of transition may be less than a quarter of the diameter of the substrate.

The curvature may be comprise a constant radius, and may be less than 0.120 inches. The curvature may be defined by a portion of an ellipse or by a portion of a parabola. The curvature may be defined by a portion of a hyperbola or a catenary, or by combinations of any conic section.

DETAILED DESCRIPTION OF THE INVENTION AND THE PREFERRED EMBODIMENT

Figure 1:
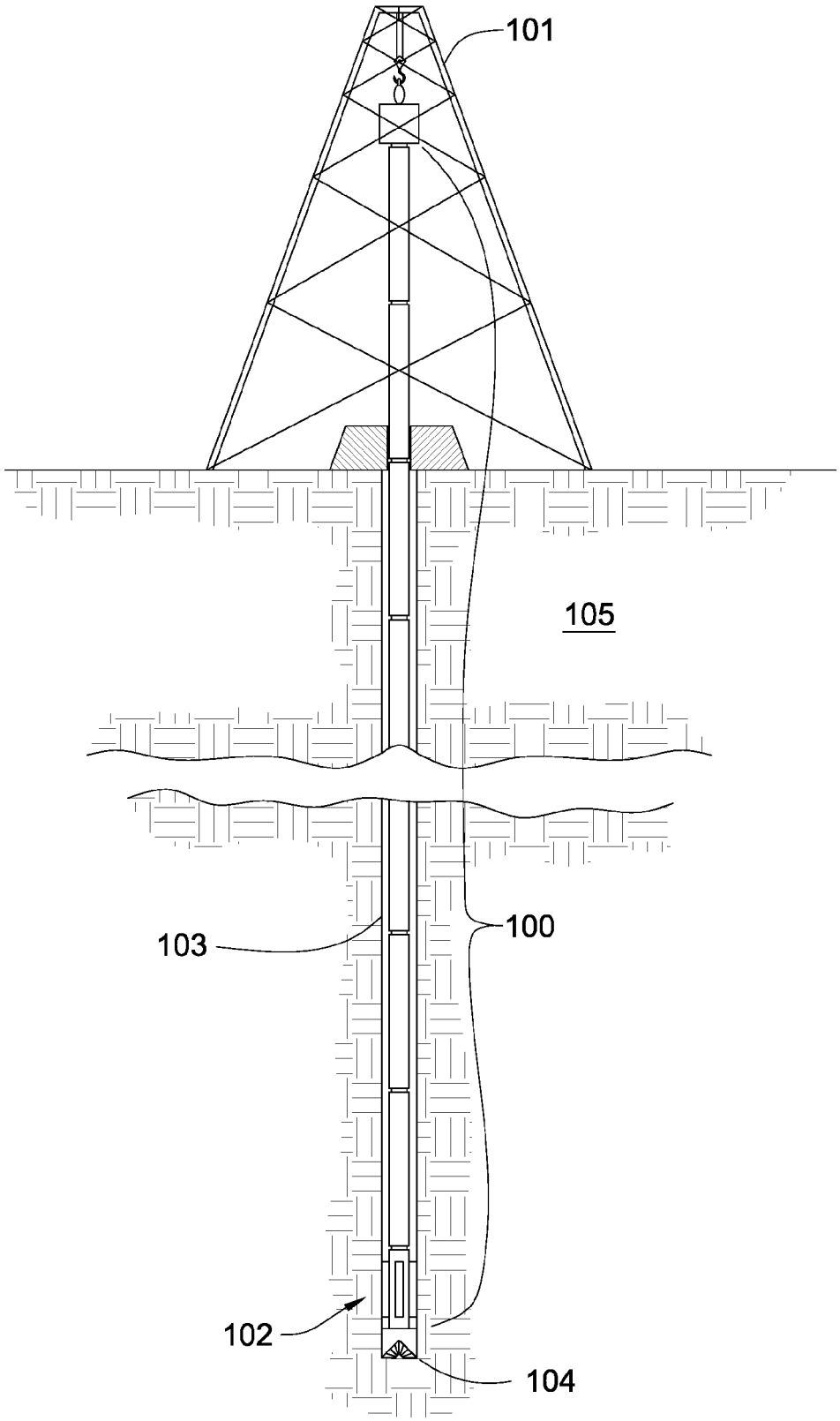
FIG. 1 is a cross-sectional view of an embodiment of a drilling operation.

Referring now to the figures, FIG. 1 is a cross-sectional diagram of an embodiment of a drill string 100 suspended by a derrick 101. A bottom hole assembly 102 is located at the bottom of a bore hole 103 and comprises a fix bladed bit 104. As the drill bit 104 rotates down hole the drill string 100 advances farther into the earth. The drill string 100 may penetrate soft or hard subterranean formations 105.

Figure 2A:
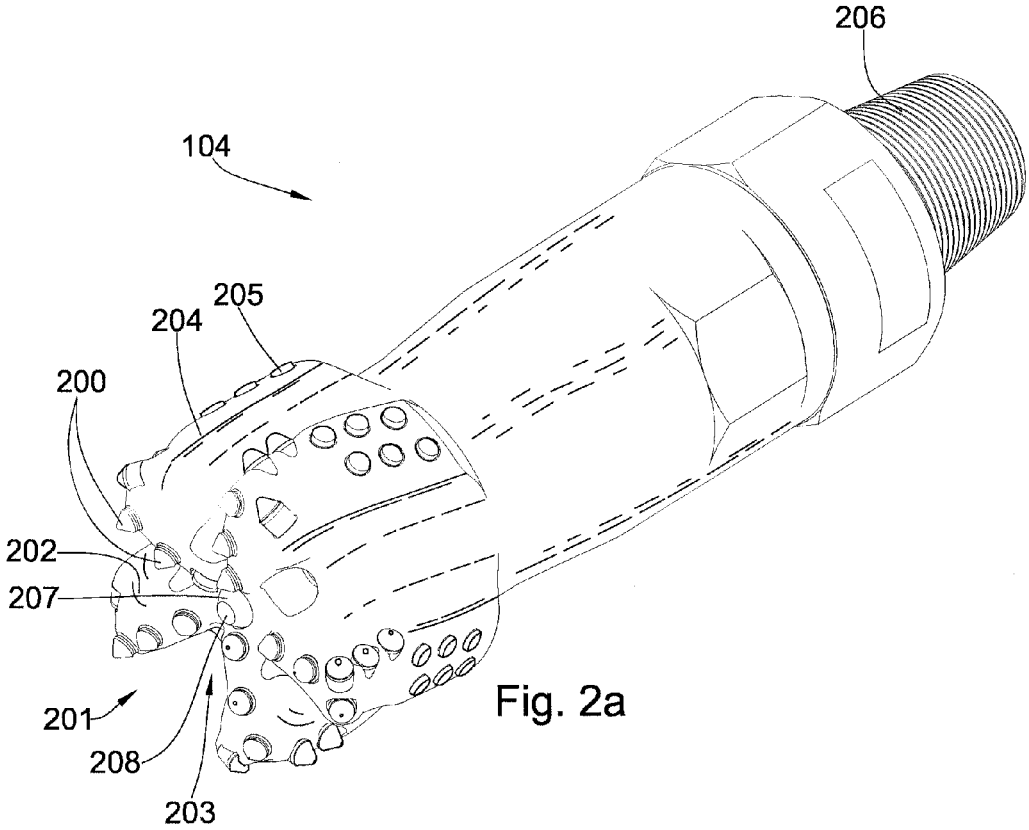
FIG. 2*a* is a perspective view of an embodiment of a drill bit.

FIG. 2*a* discloses an embodiment of a drill bit 104. Drill bit 104 comprises a working surface 201 comprising a plurality of radial blades 202. Blades 202 converge towards a center 203 of the working surface 201 and diverge towards a gauge portion 204. Blades 202 may comprise one or more cutting elements 200 that comprise a superhard material bonded to a cemented metal carbide substrate at a non-planer interface. Cutting elements 200 may comprise substantially pointed geometry, and may comprise a superhard material such as polycrystalline diamond processed in a high pressure high temperature press. The gauge portion 204 may comprise wear-resistant inserts 205 that may comprise a superhard material Drill Bit 104 may comprise a shank portion 206 that may be attached to a portion of drill string or a bottom-hole assembly (BHA). In some embodiments, one or more cutting elements 200 may be positioned on a flank portion or a gauge portion 204 of the drill bit 104.

In some embodiments, the drill bit 104 may comprise an indenting member 207 comprising a cutting element 208. Cutting element 208 may comprise the same geometry and material as cutting elements 200, or may comprise different geometry, dimensions, materials, or combinations thereof. The indenting member 207 may be rigidly fixed to the drill bit 104 through a press fit, braze, threaded connection, or other method. The indenting member may comprise asymmetrical geometry. In some embodiments, the indenting member 207 is substantially coaxial with the drill bit's axis of rotation. In other embodiments, the indenting member may be off-center.

Figure 2B:
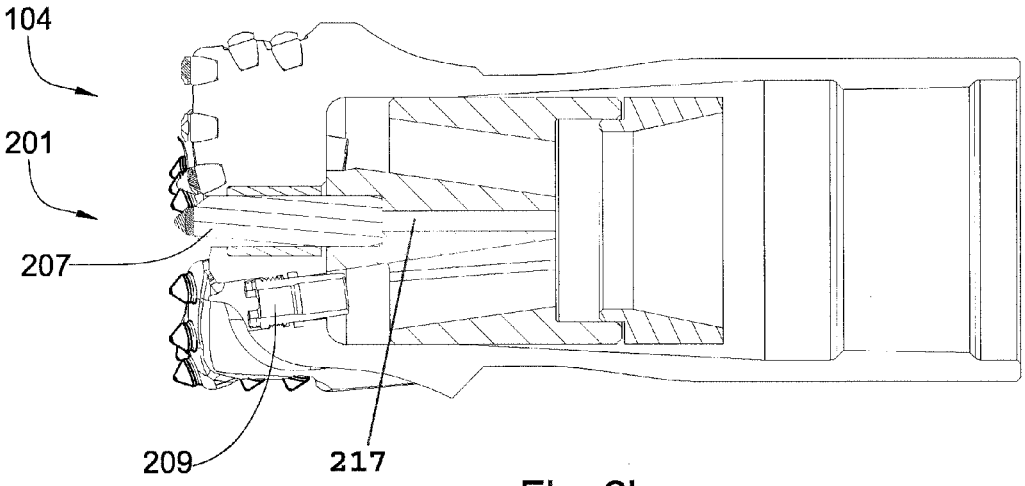
FIG. 2*b* is a cross-sectional view of another embodiment of a drill bit.

FIG. 2*b* discloses a cross section of an embodiment of a drill bit 104. An indenting member 207 is retained in the body of the drill bit. A nozzle 209 carries drilling fluid to the working surface 201 to cool and lubricate the working surface and carry the drilling chips and debris to the surface.

Figure 2C:
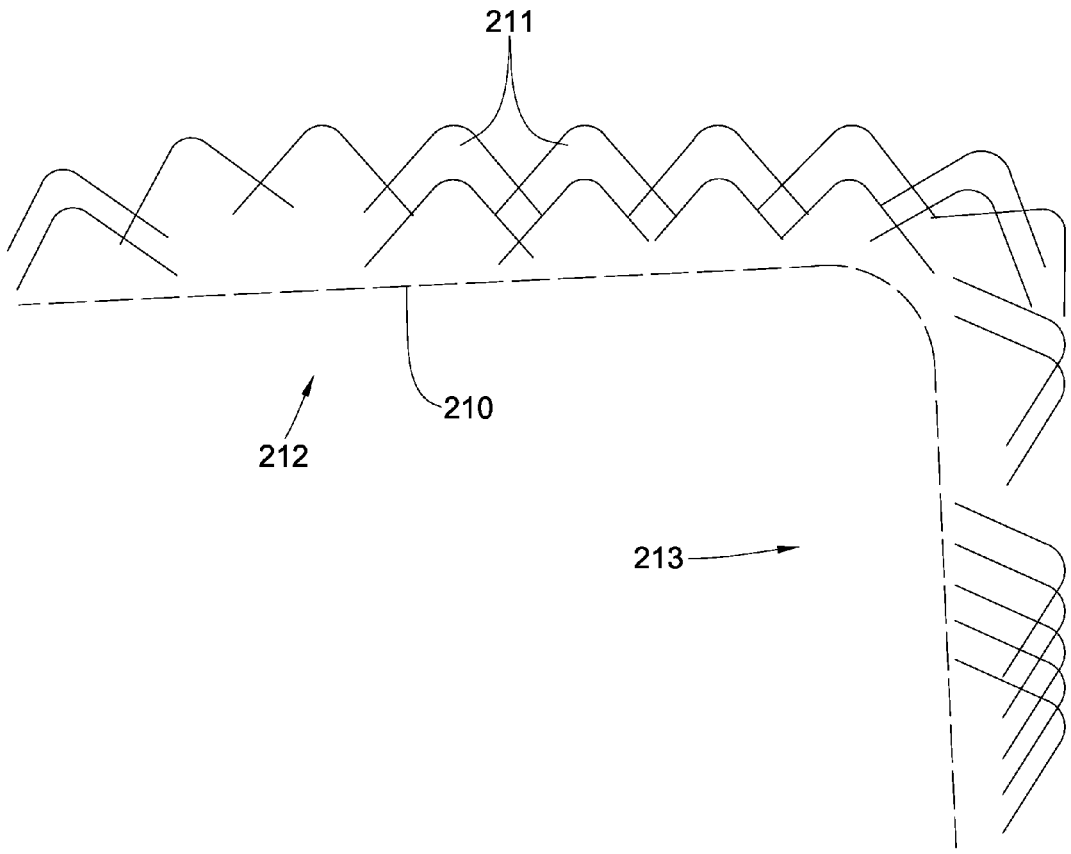
FIG. 2*c* is an orthogonal view of an embodiment of a blade cutting element profile.

FIG. 2*c* shows a profile 210 of a drill bit blade with cutter profiles 211 from a plurality of blades superimposed on the blade profile 210. Cutter profiles 211 substantially define a cutting path when the drill bit is in use. Cutter profiles 211 substantially cover the blade profile 210 between a central portion 212 of the blade profile and a gauge portion 213 of the blade profile 210.

Figure 3:
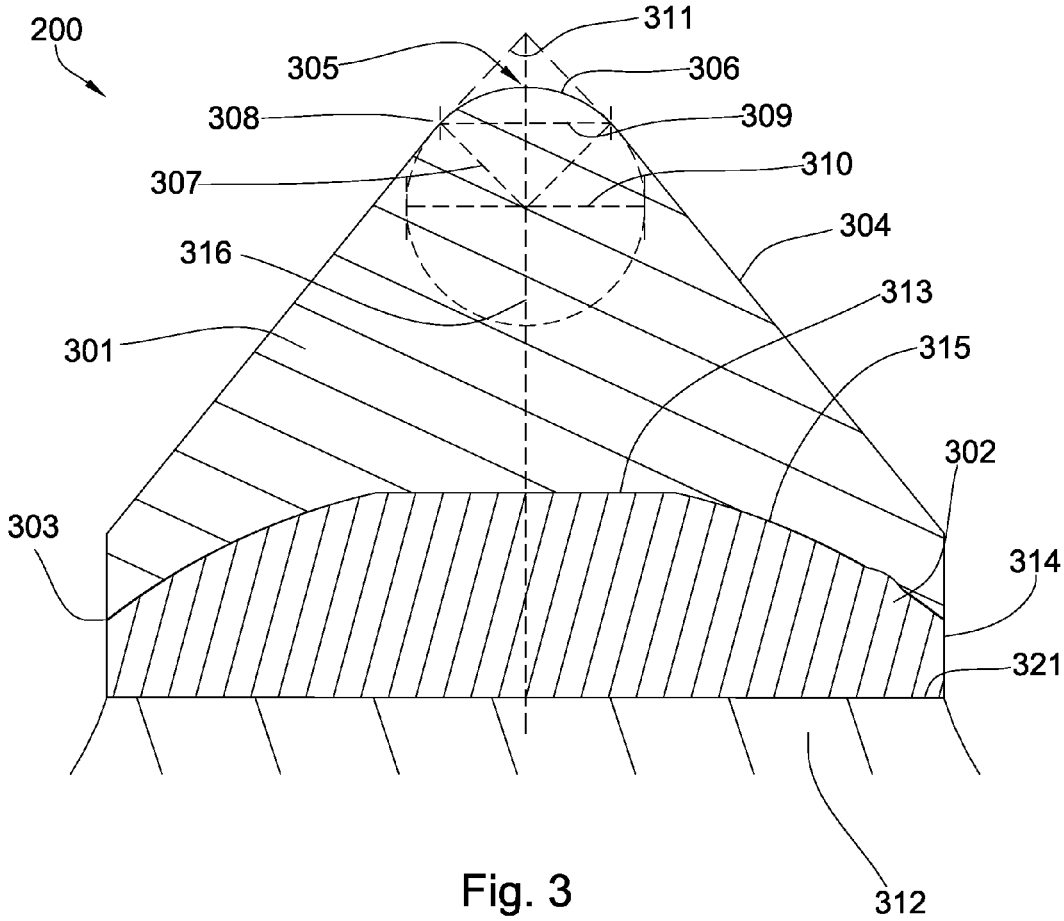
FIG. 3 is a cross-sectional view of an embodiment of a cutting element.

FIG. 3 discloses an embodiment of a cutting element 200. In this embodiment, the cutting element 200 comprises a superhard material portion 301 comprising sintered polycrystalline diamond bonded to a cemented metal carbide substrate 302 at a non-planer interface 303. The cutting element comprises substantially pointed geometry 304 and an apex 305. The apex 305 may comprise a curvature 306. In this embodiment, curvature 306 comprises a radius of curvature 307. In this embodiment, the radius of curvature 307 may be less than 0.120 inches. In some embodiments, the curvature may comprise a variable radius of curvature, a portion of a parabola, a portion of a hyperbola, a portion of a catenary, or a parametric spline. The curvature 306 of the apex 305 may join the pointed geometry 304 at a substantially tangential transition 308. The transition 308 forms a diameter of width 309 that may be substantially smaller than diameter 310, or twice the radius of curvature 307. The diameter of width 309 may be less than one third the diameter of the carbide substrate 302. In some embodiments, the diameter of width may be less than one fourth the diameter of the carbide substrate 302. An included angle 311 is formed by the walls of the pointed geometry 304. In some embodiments, the included angle may be between 75 degrees and 90 degrees. Non-planer interface 303 comprises an elevated flatted region 313 that connects to a cylindrical portion 314 of the substrate 302 by a tapered section 315. The elevated flatted region 313 may comprise a diameter of width larger than the diameter of width 309. The volume of the superhard material portion 301 may be greater than the volume of the cemented metal carbide substrate 302. The thickness of the superhard material portion along a central axis 316 may be greater than the thickness of the cemented metal carbide substrate along a central axis 316.

In some embodiments, the sintered polycrystalline diamond comprises a volume with less than 5 percent catalyst metal concentration, while 95 percent of the interstices in the sintered polycrystalline diamond comprise a catalyst.

The cemented metal carbide substrate 302 may be brazed to a support or bolster 312. The bolster may comprise cemented metal carbide, a steel matrix material, or other material and may be press fit or brazed to a drill bit body. The carbide substrate may be less than 10 mm thick along the element's central axis.

Figure 4:
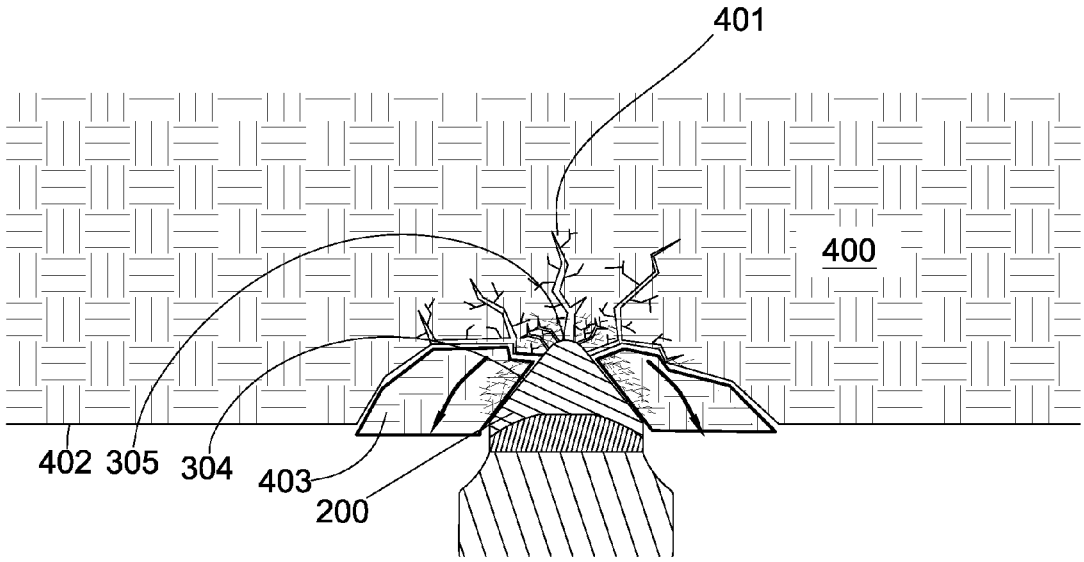
FIG. 4 is a cross-sectional view of an embodiment of a cutting element impinging a formation.

FIG. 4 discloses a cutting element 200 interacting with a formation 400. Surprisingly, the pointed cutting elements have a different cutting mechanism than the traditional shear cutters (generally cylindrical shaped cutting elements) resulting the pointed cutting element having a prolonged life. The short cutting life of the traditional shear cutter is a long standing problem in the art, which the present cutting element's curvature overcomes.

Cutting element 200 comprises pointed geometry 304 and an apex 305. The apex comprises a curvature that is sharp enough to easily penetrate the formation, but is still blunt enough to fail the formation in compression ahead of itself. As the cutting element advances in the formation, apex 305 fails the formation ahead of the cutter and peripherally to the sides of the cutter, creating fractures 401. Fractures 401 may continue to propagate as the cutter advances into the formation, eventually reaching the surface 402 of the formation 400 allowing large chips 403 to break from the formation 400. Traditional shear cutters drag against the formation and shear off thin layers of formation. The large chips comprise a greater volume size than the debris removed by the traditional shear cutters. Thus, the specific energy required to remove formation with the pointed cutting element is lower than that required with the traditional shear cutters. The cutting mechanism of pointed cutters is more efficient since less energy is required to remove a given volume of rock.

In addition to the different cutting mechanism, the curvature of the apex produces unexpected results. Applicants tested the abrasion of the pointed cutting element against several commercially available shear cutters with diamond material of better predicted abrasion resistant qualities than the diamond of the pointed cutting elements. Surprisingly, the pointed cutting elements outperformed the shear cutters. Applicant found that a radius of curvature between 0.050 to 0.120 inches produced the best wear results. The majority of the time the cutting element engages the formation, the cutting element is believed to be insulated, if not isolated, from virgin formation. Fractures in the formation weaken the formation below the compressive strength of the virgin formation. The fragments of the formation are surprisingly pushed ahead by the curvature of the apex, which induces fractures further ahead of the cutting element. In this repeated manner, the apex may hardly, if at all, engage virgin formation and thereby reduces the apex's exposure to the most abrasive portions of the formations.

Figure 5:
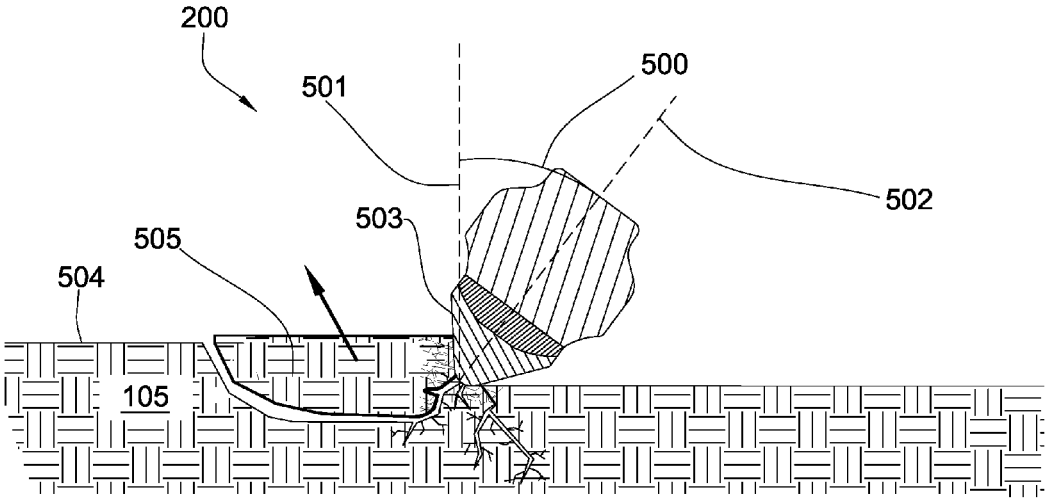
FIG. 5 is a cross-sectional view of another embodiment of a cutting element impinging a formation.

FIG. 5 discloses a cutting element 200 comprising a positive rake angle 500. Rake angle 500 is formed between an imaginary vertical line 501 and a central axis 502 of the cutting element 200. In this embodiment, positive rake angle 500 is less than one half of an included angle formed between conical side walls of the cutting element, causing a leading portion of the side wall 503 to form a negative rake angle with respect to the vertical line 501. The positive rake angle may be 15-20 degrees, and in some embodiments may be substantially 17 degrees.

As the cutting element 200 advances in the formation 400, it induces fractures ahead of the cutting element and peripherally ahead of the cutting element. Fractures may propagate to the surface 504 of the formation allowing chip 505 to break free.

Figure 6:
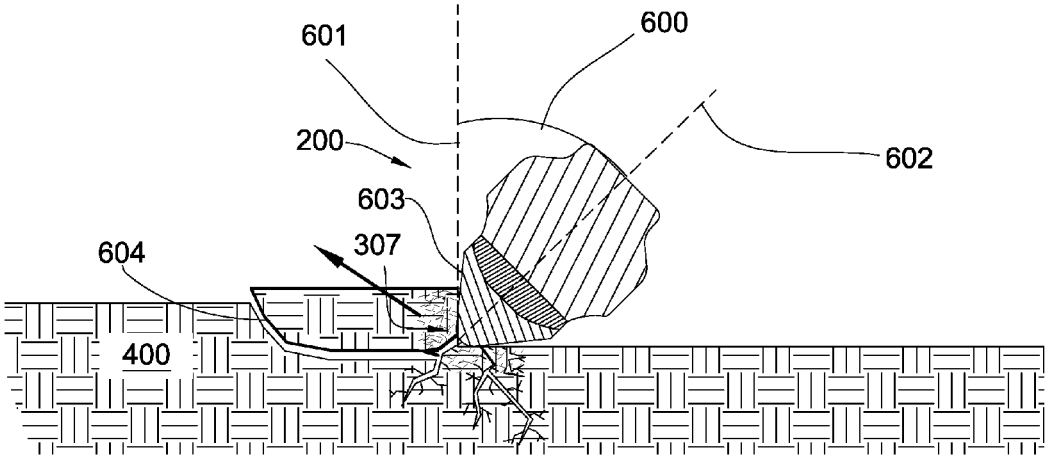
FIG. 6 is a cross-sectional view of another embodiment of a cutting element impinging a formation.

FIG. 6 discloses another embodiment of a cutting element 200 engaging a formation 400. In this embodiment, positive rake angle 600 between a vertical line 601 and a central axis 602 of the cutting element is greater than one half of the included angle formed between conical side walls of the cutting element 200, causing a leading portion of the side wall 603 to form a positive rake angle with an imaginary vertical line 601. This orientation may encourage propagation of fractures 604, lessening the reaction forces and abrasive wear on the cutting element 200.

Figure 7:
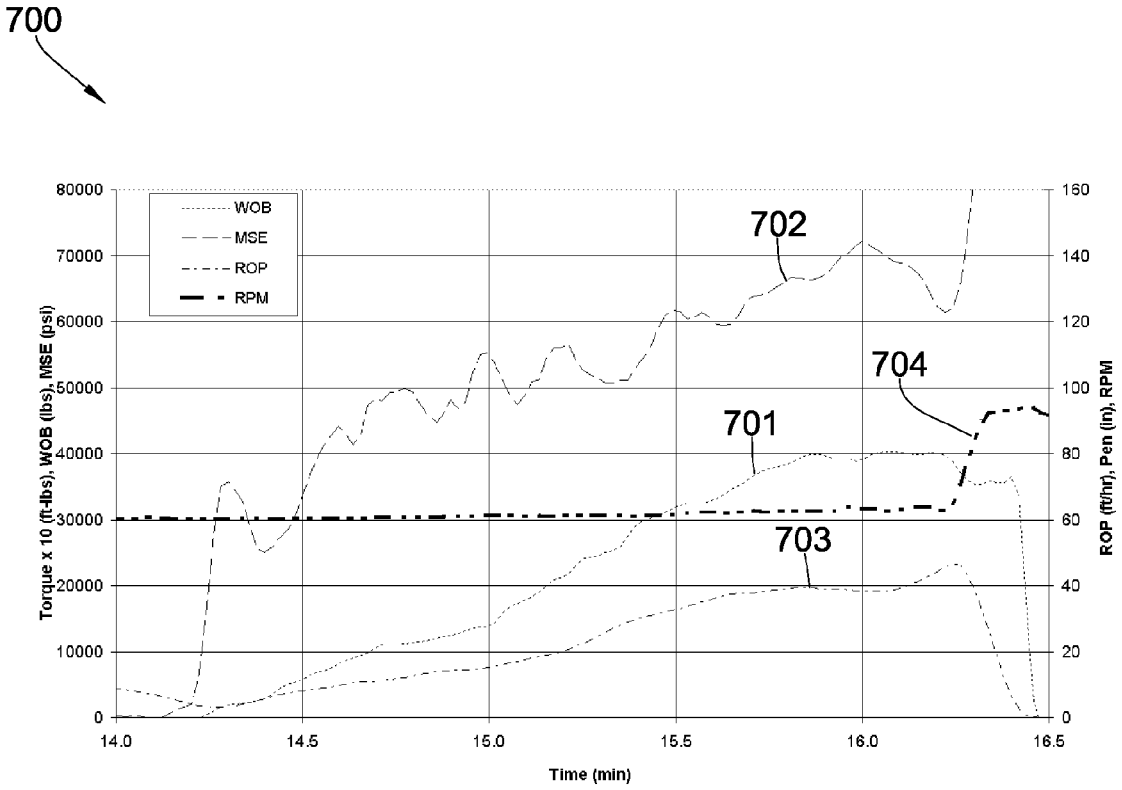
FIG. 7 is a time vs. parameter chart of an embodiment of a drill bit.

FIG. 7 is a chart 700 showing relationships between weight-on-bit (WOB) 701, mechanical specific energy (MSE) 702, rate of penetration (ROP) 703, and revolutions per minute (RPM) 704 of a drill bit from actual test data generated at TerraTek, located in Salt Lake City, Utah. As shown in the chart, ROP increases with increasing WOB. MSE 702 represents the efficiency of the drilling operation in terms of an energy input to the operation and energy needed to degrade a formation. Increasing WOB can increase MSE to a point of diminishing returns shown at approximately 16 minutes on the abscissa. These results show that the specific mechanical energy for removing the formation is better than traditional test.

Figure 8:
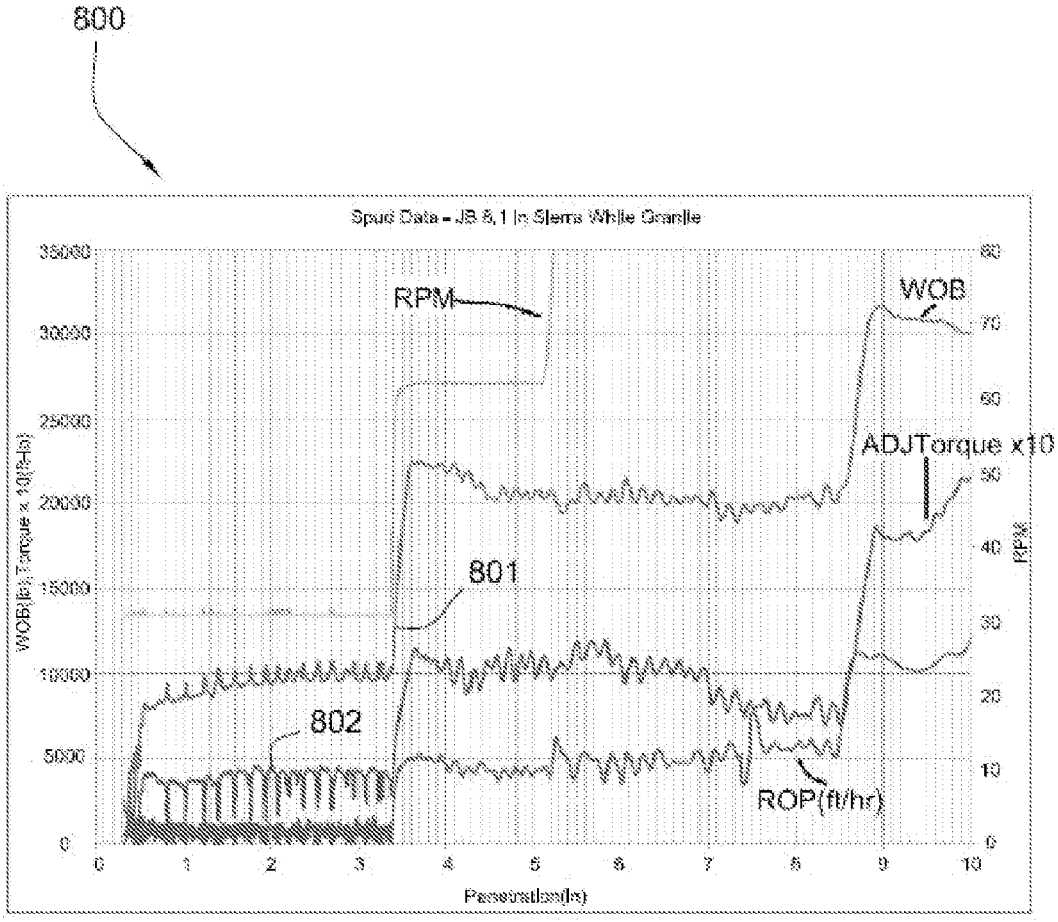
FIG. 8 is a penetration vs. parameter chart of an embodiment of a drill bit.

FIG. 8 is a chart 800 showing the drilling data of a drill bit with an indenting member also tested at TerraTek. As shown in the chart, WOB 801 and torque oscillate. Torque applied to the drill string undergoes corresponding oscillations opposite in phase to the WOB. It is believed that these oscillations are a result of the WOB reaction force at the drill bit working face alternating between the indenting member and the blades. When the WOB is substantially supported by the indenting member, the torque required to turn the drill bit is lower. When the WOB at the indenting member gets large enough, the indenting member fails the formation ahead of it, transferring the WOB to the blades. When the drill bit blades come into greater engagement with the formation and support the WOB, the torque increases. As the blades remove additional formation, the WOB is loaded to indenting member and the torque decreases until the formation ahead of the indenting member again fails in compression. The compressive failure at the center of the working face by the indenting member shifts the WOB so as to hammer the blades into the formation thereby reducing the work for the blades. The geometry of the indenting member and working face may be chosen advantageously to encourage such oscillations.

In some embodiments, such oscillations may be induced by moving the indenting member along an axis of rotation of the drill bit. Movements may be induced by a hydraulic, electrical, or mechanical actuator. In one embodiment, drilling fluid flow is used to actuate the indenting member. In the embodiment shown in FIG. 2*b*, the indenting member 207 may be moved by an actuator 217.

Figure 9:
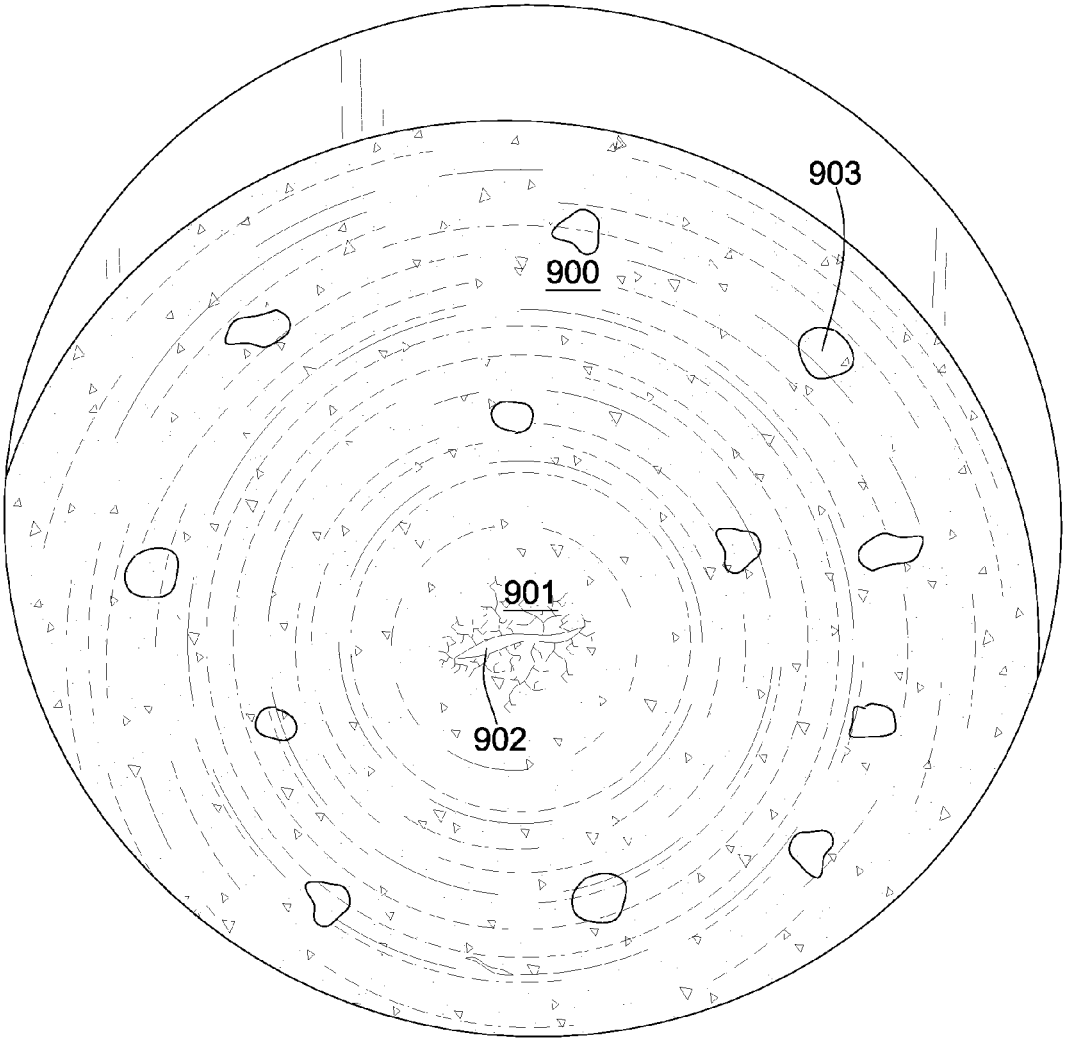
FIG. 9 is a perspective view of an embodiment of a borehole.

FIG. 9 shows a bottom of a borehole 900 of a sample formation drilled by a drill bit comprising an indenting member and radial blades comprising substantially pointed cutting elements. A central area 901 comprises fractures 902 created by the indenting member. Craters 903 form where blade elements on the blades strike the formation upon failure of the rock under the indenting member. The cracks ahead of the cutting elements propagate and create large chips that are removed by the pointed cutting elements and the flow of drilling fluid.

Figure 10:
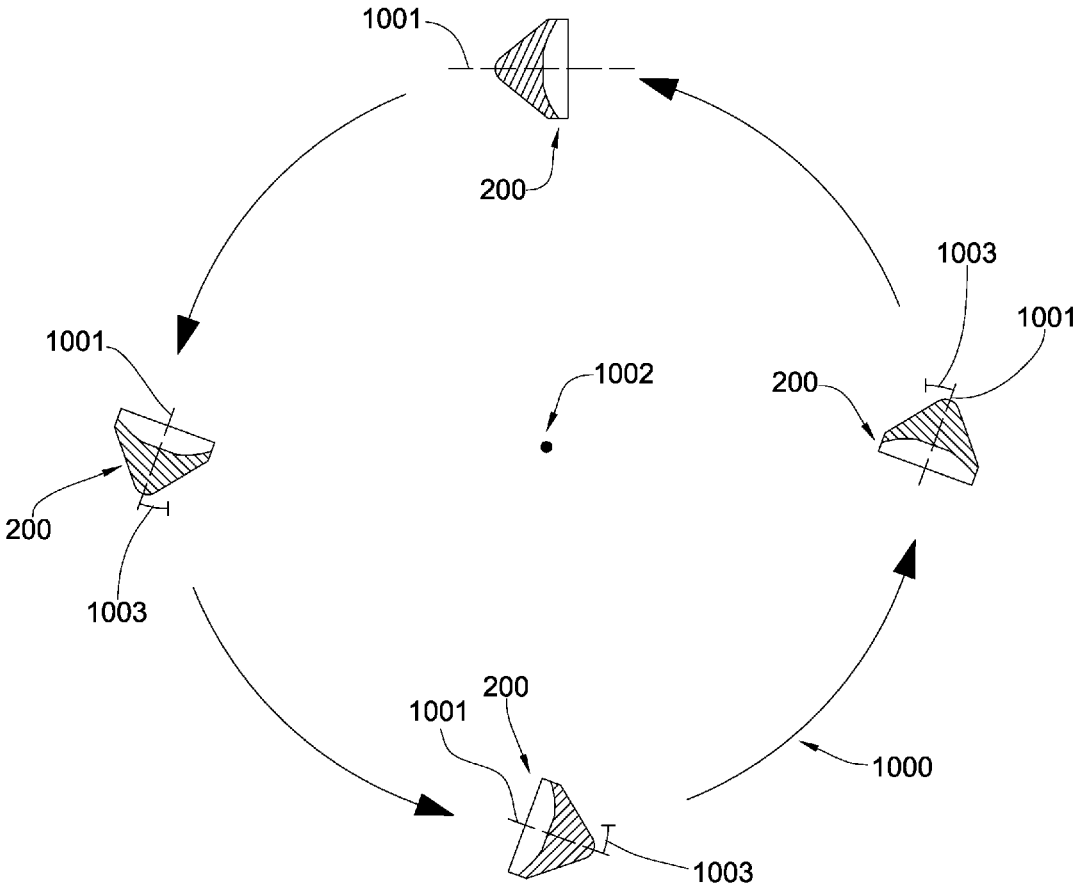
FIG. 10 is a cross-sectional view of another embodiment of a cutting element.

FIG. 10 is an orthogonal view of a cutting path 1000. A cutting element 200 comprises a central axis 1001 and rotates about a center of rotation 1002. Central axis 1001 may form a side rake angle 1003 with respect to a tangent line to the cutting path 1000. In some embodiments, side rake angle 1003 may be substantially zero, positive, or negative.

Figure 11:
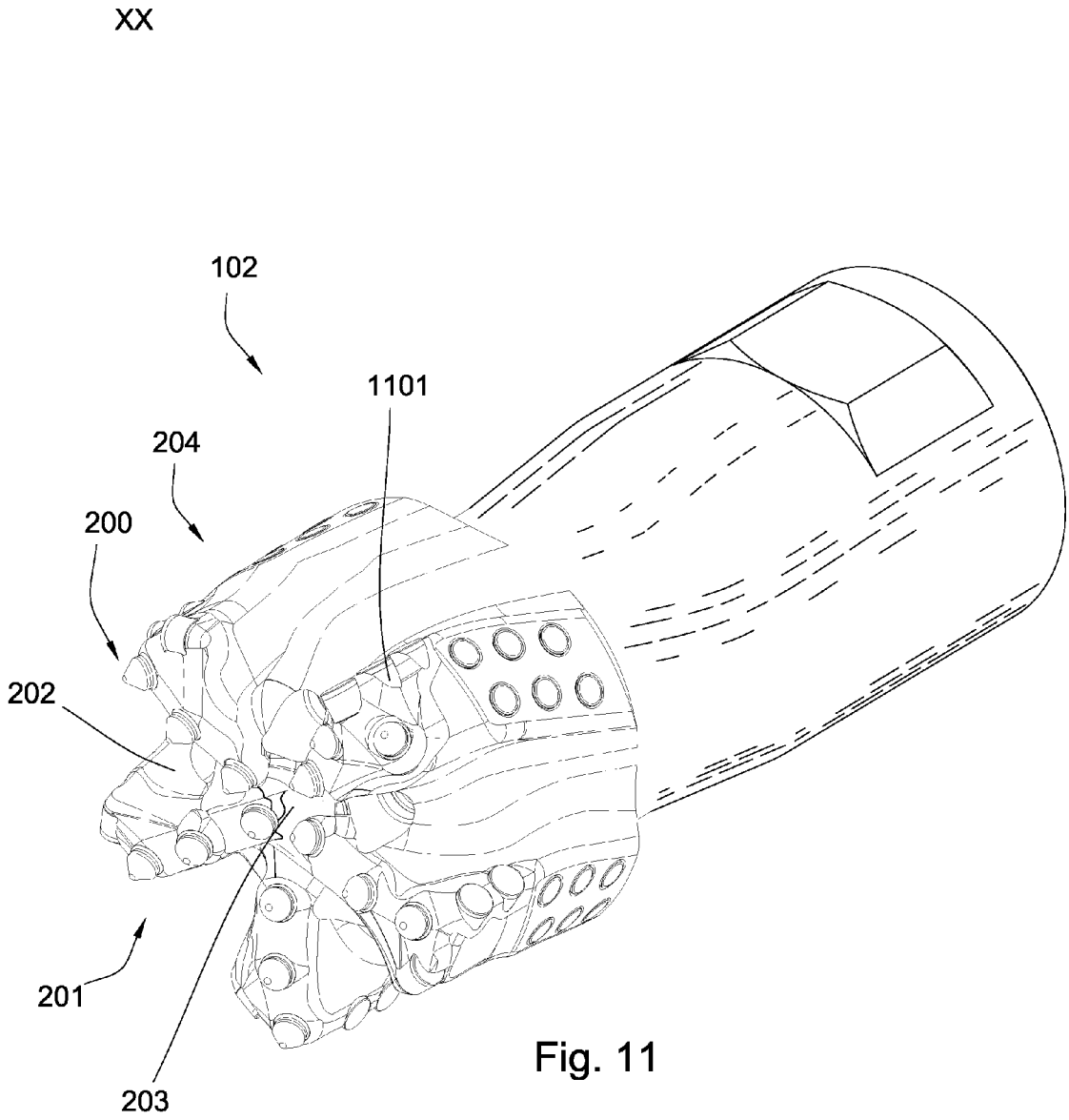
FIG. 11 is a perspective view of another embodiment of a drill bit.

FIG. 11 discloses another embodiment of a drill bit 102. This embodiment comprises a plurality of substantially pointed cutting elements 200 affixed by brazing, press fit or another method to a plurality of radial blades 202. Blades 202 converge toward a center 203 of a working surface 201 and diverge towards a gauge portion 204. Cylindrical cutting elements 1101 are affixed to the blades 202 intermediate the working surface 201 and the gauge portion 204.

Figure 12:
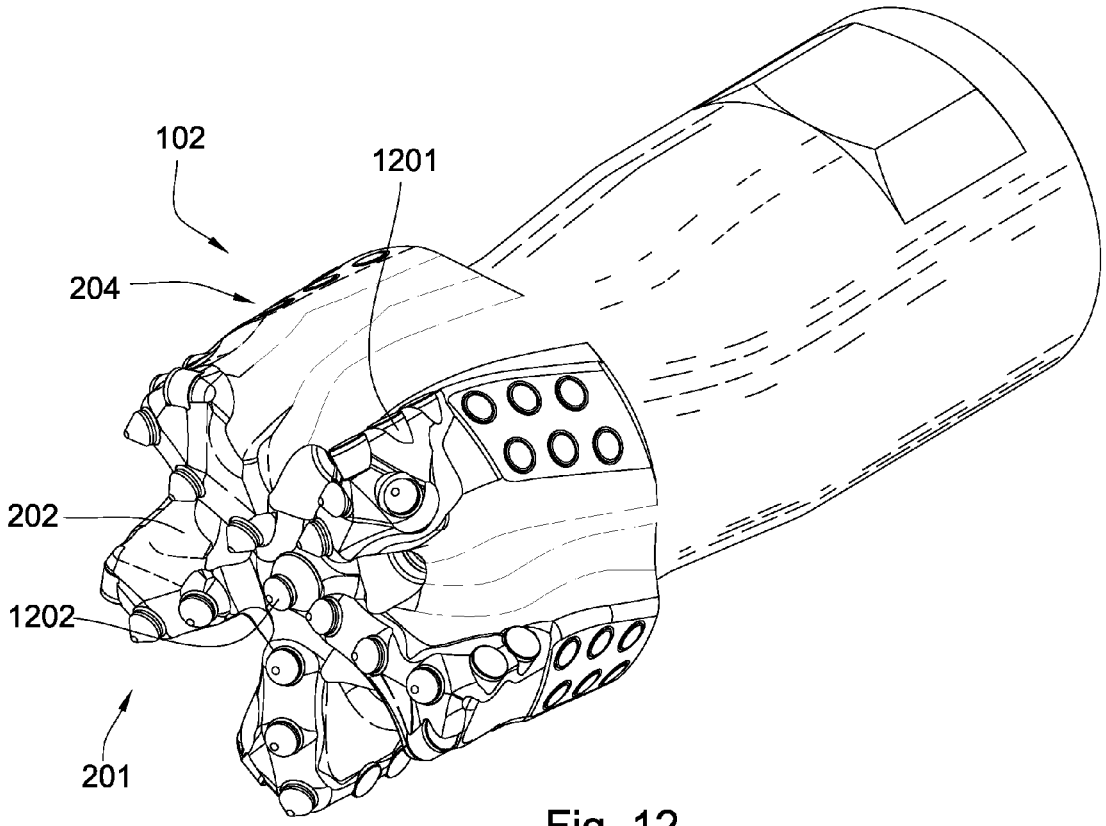
FIG. 12 is a perspective view of another embodiment of a drill bit.

FIG. 12 discloses another embodiment of a drill bit 102. In this embodiment, cylindrical cutters 1201 are affixed to radial blades 202 intermediate a working surface 201 and a gauge portion 204. Drill bit 102 also comprises an indenting member 1202.

Figure 13:
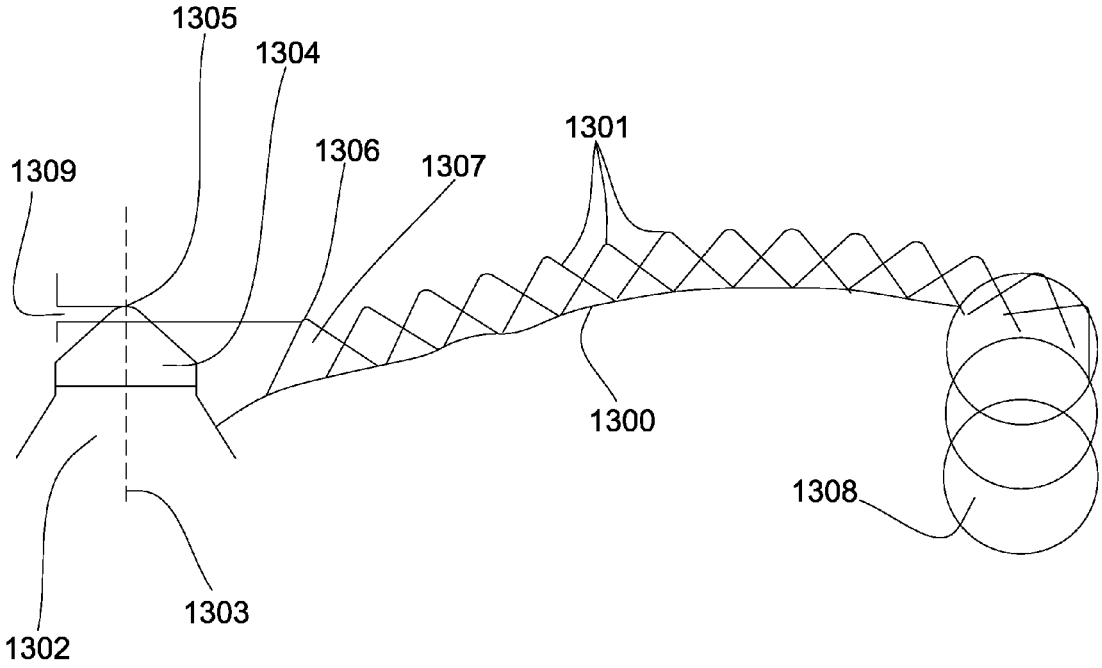
FIG. 13 is an orthogonal view of another embodiment of a blade cutting element profile.

FIG. 13 discloses another embodiment of a blade profile 1300. Blade profile 1300 comprises the superimposed profiles 1301 of cutting elements from a plurality of blades. In this embodiment, an indenting member 1302 is disposed at a central axis of rotation 1303 of the drill bit. Indenting member 1302 comprises a cutting element 1304 capable of bearing the weight on bit. An apex 1305 of the indenter cutting element 1304 protrudes a protruding distance 1309 beyond an apex 1306 of a most central cutting element 1307. Distance 1309 may be advantageously chosen to encourage oscillations in torque and WOB. Distance 1309 may be variable by moving the indenting member axially along rotational axis 1303, or the indenting member may be rigidly fixed to the drill bit. The distance in some embodiments may not extend to the apex 1306 of the central most cutting element. Cylindrical shear cutters 1308 may be disposed on a gauge portion of the blade profile 1300.

Figure 14:
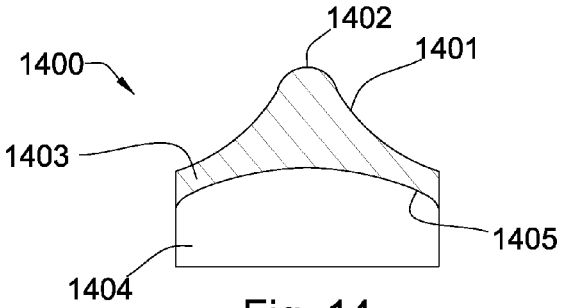
FIG. 14 is a cross-sectional view of another embodiment of a cutting element

FIG. 14 discloses an embodiment of a substantially pointed cutting element 1400. Cutting element 1400 comprises a superhard material portion 1403 with a substantially concave pointed portion 1401 and an apex 1402. Superhard material portion 1403 is bonded to a cemented metal carbide portion 1404 at a non-planer interface 1405.

Figure 15:
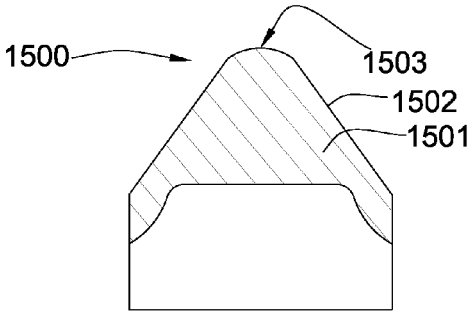
FIG. 15 is a cross-sectional view of another embodiment of a cutting element.

FIG. 15 discloses another embodiment of a substantially pointed cutting element 1500. A superhard material portion 1501 comprises a linear tapered pointed portion 1502 and an apex 1503.

Figure 16:
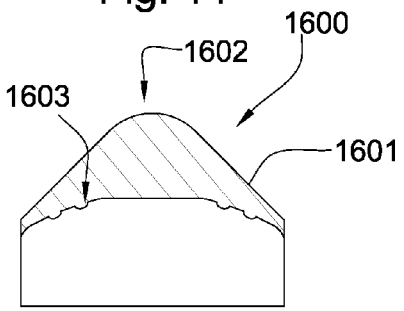
FIG. 16 is a cross-sectional view of another embodiment of a cutting element.

FIG. 16 discloses another embodiment of a substantially pointed cutting element 1600. Cutting element 1600 comprises a linear tapered pointed portion 1601 and an apex 1602. A non-planer interface between a superhard material portion and a cemented metal carbide portion comprises notches 1603.

Figure 17:
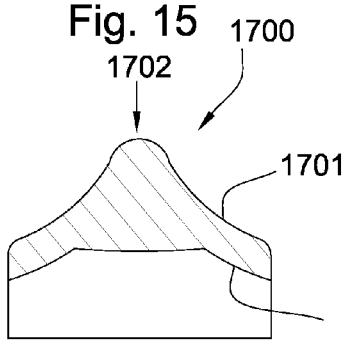
FIG. 17 is a cross-sectional view of another embodiment of a cutting element.

FIG. 17 discloses another embodiment of a substantially pointed cutting element 1700. Cutting element 1700 comprises a substantially concave pointed portion 1701 and an apex 1702.

Figure 18:
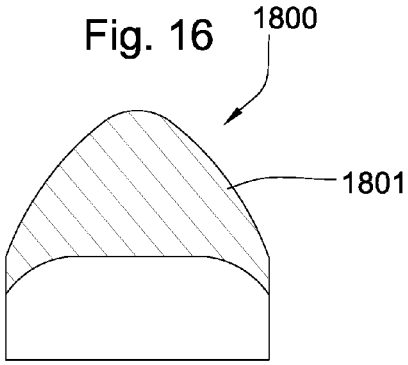
FIG. 18 is a cross-sectional view of another embodiment of a cutting element.

FIG. 18 discloses another embodiment of substantially pointed cutting element 1800. Cutting element 1800 comprises a substantially convex pointed portion 1801.

Figure 19:
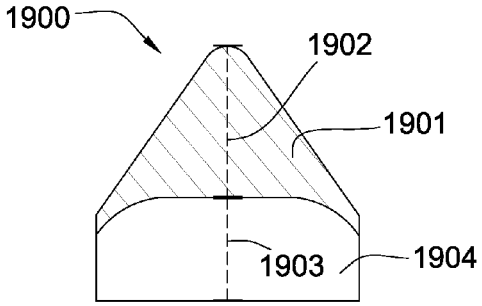
FIG. 19 is a cross-sectional view of another embodiment of a cutting element.

FIG. 19 discloses another embodiment of a substantially pointed cutting element 1900. A superhard material portion 1901 comprises a height 1902 greater than a height 1903 of a cemented metal carbide portion 1904.

Figure 20:
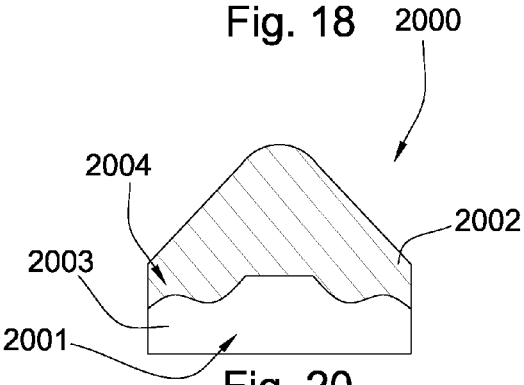
FIG. 20 is a cross-sectional view of another embodiment of a cutting element.

FIG. 20 discloses another embodiment of a substantially pointed cutting element 2000. In this embodiment, a non-planer interface 2001 intermediate a superhard material portion 2002 and a cemented metal carbide portion 2003 comprises a spline curve profile 2004.

Figure 21:
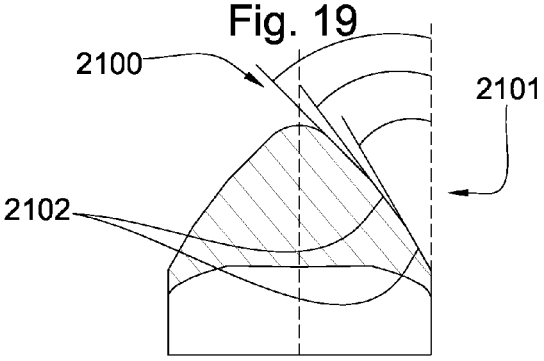
FIG. 21 is a cross-sectional view of another embodiment of a cutting element.

FIG. 21 comprises another embodiment of a substantially pointed cutting element 2100 comprising a pointed portion 2101 with a plurality of linear tapered portions 2102.

Figure 22:
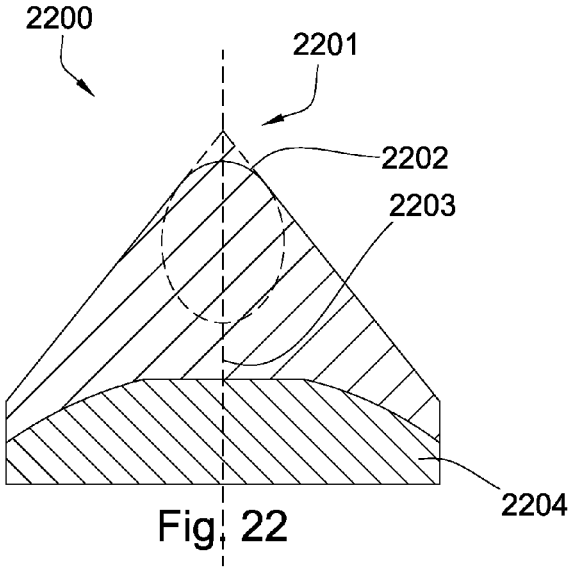
FIG. 22 is a cross-sectional view of another embodiment of a cutting element.

FIG. 22 discloses another embodiment of a substantially pointed cutting element 2200. In this embodiment, an apex 2201 comprises substantially elliptical geometry 2202. The ellipse may comprise major and minor axes that may be aligned with a central axis 2203 of the cutting element 2200. In this embodiment, the major axis is aligned with the central axis 2203.

Figure 23:
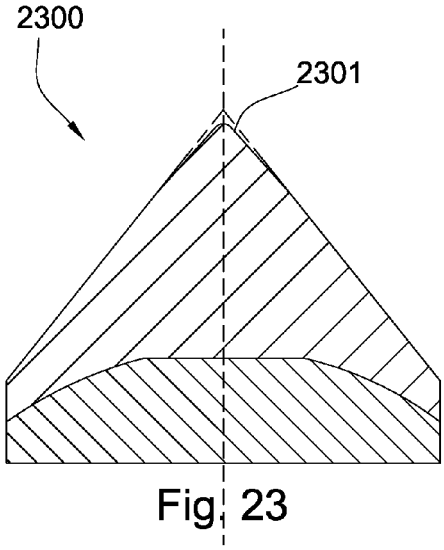
FIG. 23 is a cross-sectional view of another embodiment of a cutting element.

FIG. 23 discloses another embodiment of a substantially pointed cutting element 2300. In this embodiment, an apex 2301 comprises substantially hyperbolic geometry.

Figure 24:
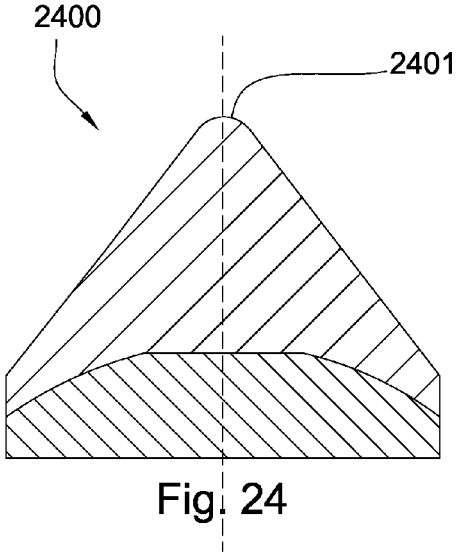
FIG. 24 is a cross-sectional view of another embodiment of a cutting element.

FIG. 24 discloses another embodiment of a substantially pointed cutting element 2400. An apex 2401 comprises substantially parabolic geometry.

Figure 25:
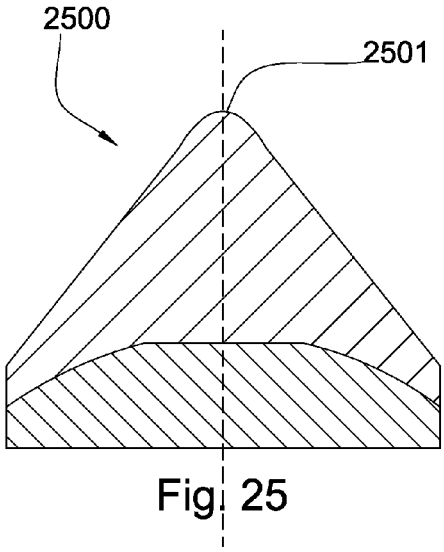
FIG. 25 is a cross-sectional view of another embodiment of a cutting element.

FIG. 25 discloses another embodiment of a substantially pointed cutting element 2500. An apex 2501 comprises a curve defined by a catenary. A catenary curve is believed to be the strongest curve in direct compression, and may improve the ability of the cutting element to withstand compressive forces.

Figure 26:
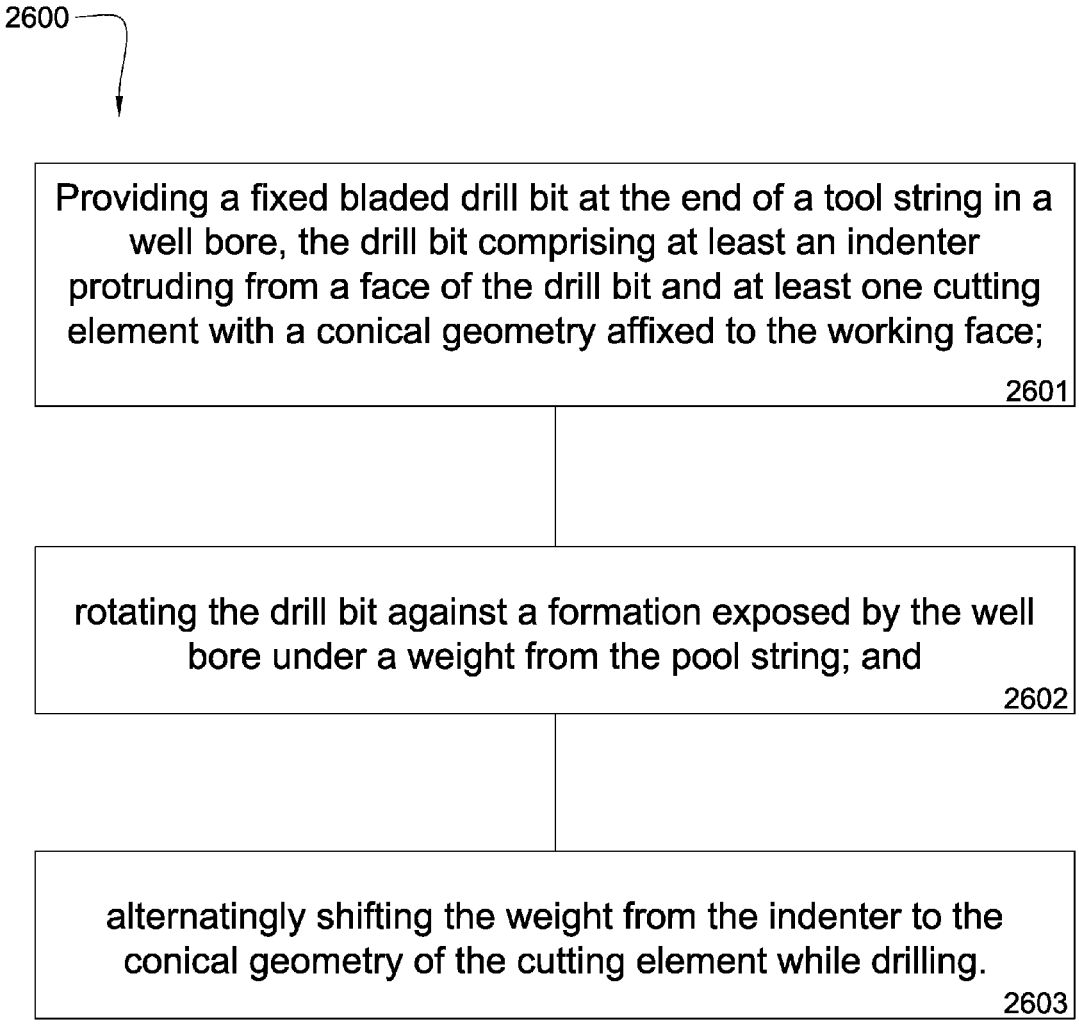
FIG. 26 is a diagram of an embodiment of a method of drilling a well bore.

FIG. 26 is a method 2600 of drilling a wellbore, comprising the steps of providing 2601 a fixed bladed drill bit at the end of a tool string in a wellbore, the drill bit comprising at least one indenter protruding from a face of the drill bit and at least one cutting element with a pointed geometry affixed to the working face, rotating 2602 the drill bit against a formation exposed by the wellbore under a weight from the tool string, and alternately 2603 shifting the weight from the indenter to the pointed geometry of the cutting element while drilling.

Figure 27:
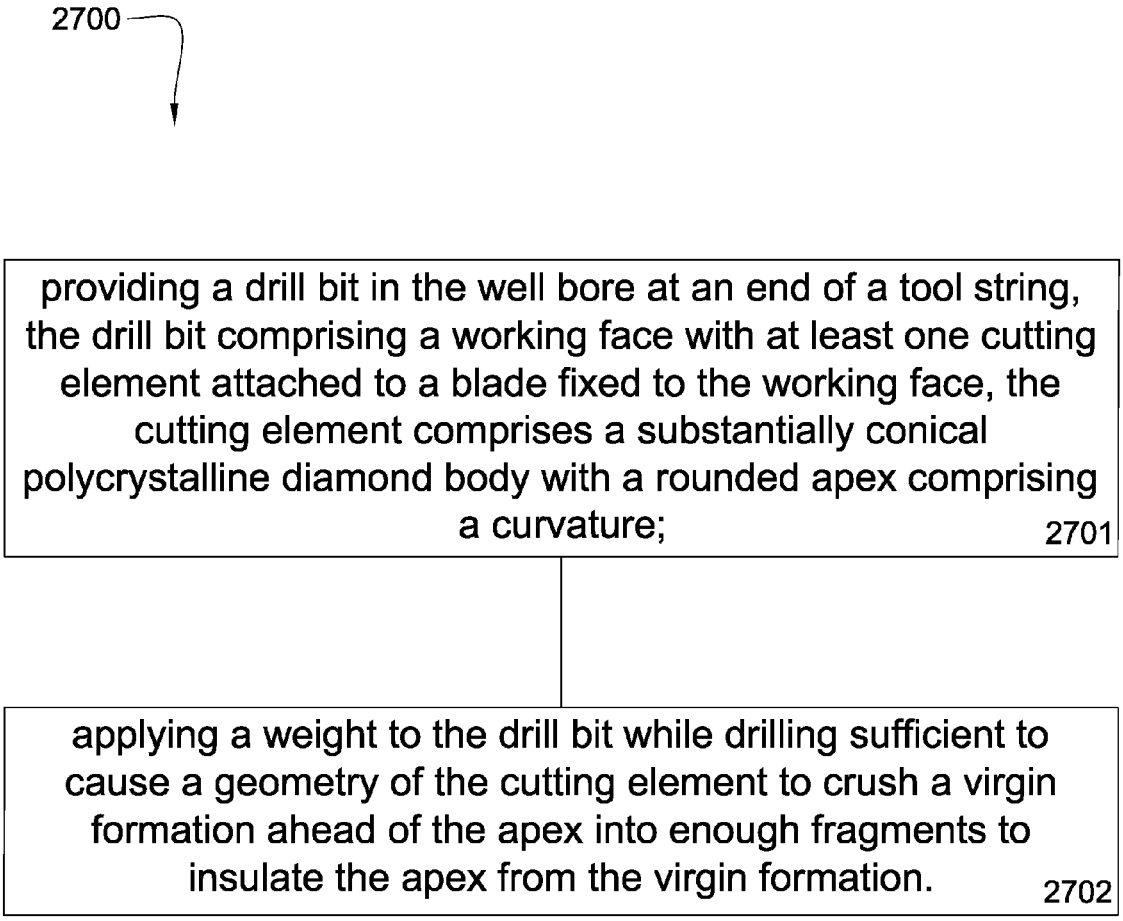
FIG. 27 is a diagram of another embodiment of a method of drilling a well bore.

FIG. 27 is a method 2700 for drilling a wellbore, comprising the steps of providing 2701 a drill bit in a wellbore at an end of a tool string, the drill bit comprising a working face with at least one cutting element attached to a blade fixed to the working face, the cutting element comprising a substantially pointed polycrystalline diamond body with a rounded apex comprising a curvature, and applying 2702 a weight to the drill bit while drilling sufficient to cause a geometry of the cutting element to crush a virgin formation ahead of the apex into enough fragments to insulate the apex from the virgin formation.

The step of applying weight 2702 to the drill bit may include that the weight is over 20,000 pounds. The step of applying weight 2702 may include applying a torque to the drill bit. The step of applying weight 2702 may force the substantially pointed polycrystalline diamond body to indent the formation by at least 0.050 inches.

Whereas the present invention has been described in particular relation to the drawings attached hereto, it should be understood that other and further modifications apart from those shown or suggested herein, may be made within the scope and spirit of the present invention.

What is claimed is:

1. A fixed bladed drill bit, comprising:

a working face and a plurality of blades that converge at the center of the working face and diverge radially towards a gauge of the bit;

a plurality of cutting elements fixed to the plurality of blades, wherein the cutting elements on the working face comprise a plurality of pointed cutting elements comprising a substantially conical geometry with an apex, wherein the apex comprises a curvature;

an indenter;

an indenter cutting element secured to the indenter, wherein the indenter cutter element comprises a pointed end that protrudes a distance beyond the apex of a most central pointed cutting element; and an actuator for moving the indenter along an axis of rotation of the bit with respect to the working face.

2. The bit of claim 1, wherein when the weight of the drill bit is shifted to the indenter, a torque on the bit is reduced.

3. The bit of claim 1, wherein when the weight of the drill bit is shifted to the plurality of cutting elements, a torque on the bit is increased.

4. The bit of claim 1, wherein the substantially conical geometry comprises a side wall that tangentially joins the curvature, wherein the at least one cutting element is positioned to indent at a positive rake angle, while a leading portion of the side wall is positioned at a negative rake angle.

5. The bit of claim 1, wherein an axis of the at least one cutting element forms a 13 to 23 degree rake angle.

6. The bit of claim 1, wherein the at least one cutter is affixed to the gauge.

7. The bit of claim 1, wherein the at least one cutter is a closest cutter element to the indenter.

8. The bit of claim 1, wherein the indenter protrudes within a region from the working face defined by the plurality of cutters.

9. A method of drilling a wellbore, comprising the steps of:

providing a fixed bladed drill bit at the end of a tool string in a well bore, the drill bit comprising at least:

a working face and a plurality of blades that converge at the center of the working face and diverge radially towards a gauge of the bit;

an indenter protruding from a face of the drill bit, wherein an indenter cutting element is secured to the indenter; and at least one pointed cutting element with a conical geometry affixed to the plurality of blades at the working face;

rotating the drill bit against a formation exposed by the well bore under a weight from the tool string; and moving the indenter along an axis of rotation of the drill bit with respect to the working face, there by alternatingly shifting the weight from the indenter to the conical geometry of the pointed cutting element while drilling.

10. The method of claim 9, wherein the step of shifting also fluctuates a torque on the drill bit.

11. The method of claim 9, wherein the step of providing includes that the indenter protrudes within a region from the working face defined by the plurality of cutters.

12. The method of claim 9, wherein the step of rotating causes the formation to break peripherally ahead of the cutting element.

13. The drill bit of claim 1, wherein the indenter cutting element has the same geometry as at least one of the plurality of pointed cutting elements.

14. The drill bit of claim 1, wherein the indenter cutting element has a different geometry than the plurality of pointed cutting elements.

* * * * *